United States Patent [19]

Borter

[11] 4,439,655

[45] Mar. 27, 1984

[54] PUSH BUTTON FOR ELECTRICAL SWITCH

[75] Inventor: Ephraim Borter, Buchrain, Switzerland

[73] Assignee: Inventio AG, Hergiswil, Switzerland

[21] Appl. No.: 434,927

[22] Filed: Oct. 18, 1982

[30] Foreign Application Priority Data

Nov. 6, 1981 [CH] Switzerland ..... 7103/81

[51] Int. Cl.[3] ..... H01H 3/12

[52] U.S. Cl. ..... 200/340

[58] Field of Search ..... 200/5 A, 159 A, 159 B, 200/159 R, 340, 330

[56] References Cited

U.S. PATENT DOCUMENTS

| | | | |
|---|---|---|---|
| 3,239,641 | 3/1966 | Pettit | 200/330 |
| 3,255,333 | 6/1966 | Schuchard | 200/340 |
| 3,367,206 | 2/1968 | Moody | 200/340 |
| 3,641,286 | 2/1972 | Berezowski | 200/159 R |

FOREIGN PATENT DOCUMENTS

| | | | |
|---|---|---|---|
| 50895 | 11/1966 | Fed. Rep. of Germany | 200/159 R |
| 1419830 | 10/1965 | France | 200/340 |
| 2280964 | 2/1976 | France | 200/340 |

*Primary Examiner*—John W. Shepperd
*Attorney, Agent, or Firm*—Werner W. Kleeman

[57] ABSTRACT

In the design of electrical switchboards or control panels or the like there are employed push buttons for the actuation of a switch for performing a desired control function or operation. There is disclosed a push button containing a solid or rigid front impact flange member and a rear impact cam or detent which is arranged at the tip of a tongue-like spring member or resilient tongue and possesses an inclined guide surface. The push button can be mounted in the cover plate of an assembled switchboard or control panel or the like, without the need for any auxiliary tools, and is positively self-retained thereat without there being required access to the rear side of the cover plate or to the interior of the switchboard panel. A spring-biased support member of a switch arranged rearwardly of the cover plate presses the push button at its near impact surface against the rear side or face of the cover plate and retains such in the desired rest position. The push button can be again dismantled, with the aid of extraordinarily simple means, out of a completely assembled together unit without there being necessitated any access to the rear side of the cover plate.

2 Claims, 4 Drawing Figures

PUSH BUTTON FOR ELECTRICAL SWITCH

BACKGROUND OF THE INVENTION

The present invention relates to a new and improved construction of a front end-actuated push button or knob for electrical switches, hereinafter simply referred to as a push button.

Generally speaking, the push button of the present development, which is particularly used for the actuation of electrical switches, is of the type which is guided and retained in a cover plate or the like of a piece of equipment, such as a switchboard or control panel, and is manually actuated against the force of a pushing or ejection spring. In order to limit the actuation path of the push button there is provided a front, solid or rigid flange member, and for limiting the return or ejection path there is provided a rear impact or stop member.

Push buttons usually possess a rigid or solid front flange member. They are inserted into the cover plate from the front side or face thereof and thereafter secured against dropping-out by attaching a removable rear impact member. The push buttons are thus securely connected with the cover plate so that they cannot detach therefrom and become lost, and in this way there is ensured for a simple mounting or assembly of the cover plate upon the separately installed electrical switching apparatus or the like.

There have become known to the art push buttons containing different constructions of holder or retention devices for the removable rear impact members, such as for instance expandable rings formed of spring steel, mountable contact-making cable shoes and so forth.

In Swiss Pat. application No. 412,045 there has been disclosed a push button, wherein the rear impact or stop member consists of two parts which are joined together with the push button, namely a rubber O-ring and an impact or stop ring member possessing an angled or cornered cross-sectional configuration. The rear portion of the push button itself is equipped with a semi-circular-shaped circumferential groove. There is pushed onto the rear end of the push button inserted into the cover plate the impact ring member with the smaller internal diameter thereof leading. Thereafter, the rubber O-ring is placed into the circumferential groove and the impact ring member is pushed back downwardly over the rubber O-ring. Both of these auxiliary parts mutually secure one another; while the impact ring member is retained upon the push button by the action of the rubber O-ring, the impact ring member, in turn, prevents jumping-out of the rubber O-ring from the circumferential groove by means of its outer leg which encircles the rubber O-ring.

Apart from the advantages which such prior art construction of push button affords, such as assembly and disassembly without the need for auxiliary tools, or the impact member which is spring-loaded or resiliently biased by the rubber ring, nonetheless all of the heretofore known constructions of push buttons are afflicted with the common drawback that during the assembly thereof at a cover plate or the like they must be joined together from a number of separate parts, and they only can be mounted or removed if the cover plate is dismantled and there is afforded access from the rear side thereof.

SUMMARY OF THE INVENTION

Therefore, with the foregoing in mind it is a primary object of the present invention to provide an improved construction of push button which is not associated with the aforementioned drawbacks and limitations of the prior art constructions.

Another and more specific object of the present invention is directed to a new and improved construction of a push button which can be subsequently externally mounted, without the need to resort to the use of additional tools, as a compact unit at finished assembled together push button cabinets or consoles or switching panels and are automatically fixedly secured thereto, and furthermore, such push buttons can be again dismantled from the outside through the use of the most simple auxiliary means or aids and without the need to dismantle the cover plate or the like.

Still a further significant object of the present invention is directed to a new and improved construction of a push button, especially for electrical switches, which is relatively simple in design, extremely economical to manufacture, extraordinarily easy to mount and again dismantle at a switching panel or the like, without the need to resort to the use of special auxiliary tools.

Now in order to implement these and still further objects of the invention, which will become more readily apparent as the description proceeds, the push button of the present development is manifested by the features that, the rear impact or stop member comprises at least two impact detents or cams which are slightly resiliently yieldable and which are located at opposite sides of the push button, i.e., the body of the push button. These impact detents are constructed such that they possess impact or contact surfaces which extend substantially parallel to the cover plate.

Some of the more notable advantages of the present invention essentially reside in the fact that, the push button can be mounted, without the need for any tool, at the front side or face of a cover plate or the like of a switching or control panel or other appropriate piece of equipment and is automatically retained therein, without there being necessitated access to the rear side or face of the cover plate. Furthermore, the push button can be again easily removed or dismantled from the cover plate with the aid of a simple strip member, for instance, formed of a thin PVC-foil, without the need to dismantle the cover plate. For this purpose, the foil or the like is inserted at both of the holding or mounting sides or the push button between the push button body and its slide guide or guide means, until the impact detents of the rear impact member are positively covered by the inserted foil. To facilitate this removal technique the push button can be slightly inwardly depressed into an intermediate position. Now it is possible to easily remove the push button out of the cover plate, and specifically, in the most advantageous manner if the push button and the foil are conjointly seized by the fingers of the operator and pulled out of the cover plate. Instead of using a PVC-foil it would also be possible to use another strip of material, such as a strip of a thin but rigid or stiff piece of paper.

A further advantage of the invention resides in the fact that, assuming for instance that the push buttons are used with a switching or control panel or switchboard for performing specific functions, such as in the environment of an elevator system, then subsequent changes of the building storey or function markings or other written designations can be easily accomplished by exchanging within seconds the correspondingly marked push buttons, without the need to perform other dismantling or knock-down work.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
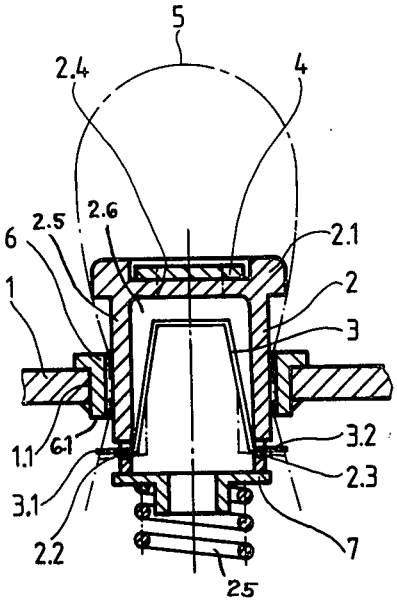
FIG. 1 is a fragmentary sectional view illustrating a cover plate or the like containing a push button mounted therein and constructed according to the invention.
Figure 2:
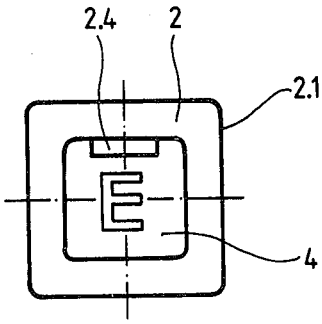
FIG. 2 is a top plan view of the push button depicted in FIG. 1.

Describing now the drawings, in FIGS. 1 and 2 there has been illustrated a cover plate 1 of any suitable device or piece of equipment with which the push button 2 of the present development is used. This cover plate 1 or the like contains a throughpass hole or bore 1.1 for the mounting therein of a slide guide or guide means 6 and its related push button 2. This push button 2 has a push button body 2.5 which possesses at the end thereof protruding out of the cover plate 1 a front flange member 2.1. At the opposite end of the push button body 2.5 there are provided two transversely extending slots 2.2 and 2.3 arranged forwardly of a rear opening of such hollow push button body 2.5. This push button body 2.5 contains at its front end an opening or recess 2.4 which allows for the departure of light from a not particularly illustrated indicator or display lamp and contains an adhesively bonded marking or marker plate 4 to which there may be applied a suitable inscription or marking, as shown in FIG. 2. Reference character 3 designates a substantially U-shaped holder or retention blade spring or equivalent structure possessing two flexed leg members 3.1 and 3.2 bent outwardly away from the holder blade spring 3 which is inserted into the hollow space 2.6 of the push button body 2.5. There is also shown, in broken or phantom lines, a strip member 5 of approximately, for instance, 12 mm width, constituting a switch-dismantling foil. The slide guide or guide means 6 is inserted in and affixed in the throughpass hole or opening 1.1 of the cover plate 1. A spring-loaded support member 7, acted upon by a return or push-back spring 25, of a not particularly illustrated switch arranged rearwardly of the push button 2 retains the latter in a desired rest position. The leg members 3.1 and 3.2 define impact detents having impact surfaces extending substantially parallel to the cover plate 1 and cooperate with the rear end 6.1 of the guide means 6.

At this point reference will be made to the modified construction of push button depicted in FIGS. 3 and 4, where there will be likewise seen a cover plate 11 or the like which also possesses a throughpass hole or opening 11.1 for the mounting therein of a push button 12 containing a push button body 12.8. Latched into the throughpass hole or opening 11.1 is a slide guide or guide means 14 which receives the push button body 12.8. The push button 12 is formed, for instance by a molding or pressing operation, from a suitable plastics material and possesses a front flange member 12.7 and a rear impact or stop member composed of two resilient tongues or tongue-like springs 12.1 and 12.2, each having an inclined guide surface 12.3 and 12.4 and an impact detent or cam 12.5 and 12.6, respectively. These resilient tongues or tongue members form part of the side wall of the push button body 12.8, and each impact detent 12.5 and 12.6 has a substantially triangular cross-sectional configuration. These impact detents 12.5 and 12.6 also contain impact surfaces extending substantially parallel to the cover plate 1. Here also an approximately 12 mm wide strip 15 constituting a push button-dismantling foil has been shown in broken or phantom lines. Arranged in the hollow space 12.9 of the push button 12 is a non-transparent but light-passing or translucent insert member 13 formed of a pressed or molded plastics material. This insert member 13 can be devoid of any markings or indicia or can be provided with a suitable marking which, for instance, indicates the function of the related push button 12, for instance can be constituted by the floor or storey marking of a building of an elevator system. A spring-biased support member 17, acted upon by a return or push-back spring 30, of a not particularly illustrated but conventional switch which is arranged at the rear side of the cover plate 11 also serves to retain this push button 12 in the desired rest position.

Having now had the benefit of the foregoing discussion of the depicted exemplary embodiments of push buttons their mode of operation will be considered and is as follows:

The push button depicted in FIGS. 1 and 2 can be inserted into a finished assembled control panel or cabinet or the like which is closed by the cover plate 1 from the outside into such cover plate 1 in that, by slightly inclinedly positioning the push button 2 one of the legs or leg members 3.1 or 3.2 of the blade spring 3 or equivalent resilient structure and protruding out of the push button body 2.5 can be inwardly pressed by the action of the slide guide or guide means 6 until it is essentially flush with the related outer surface of the push button 2. The other leg member likewise can be inwardly pressed, for instance with the finger nail of the operator, so as to be likewise essentially flush with the other opposite outer surface of the push button 2, so that the push button then can be pushed into the guide means 6. As soon as both of the legs or leg members 3.1 and 3.2 of the blade spring 3 have moved past the rear end 6.1 of the guide means 6 these leg members 3.1 and 3.2 again jump towards the outside, and consequently, the push button 2 remains fixed in the cover plate 1, on the one hand by the action of the blade spring-leg members 3.1 and 3.2 and, on the other hand, by the action of the front flange member 2.1. The spring-loaded support member 7 of the not particularly illustrated rear switch retains the push button 2 in the proper rest position. Upon actuation of this push button 2 the movement is limited by impact of the front flange member 2.1 against the slide guide or guide means 6. When the push button 2 is released then it snaps back under the action of the spring-loaded support member 7 of the rearwardly installed or rear switch into its rest position. Dismantling of the push button 2 is accomplished with the aid of the PVC-foil or strip 5 in the manner already previously explained.

Figure 3:
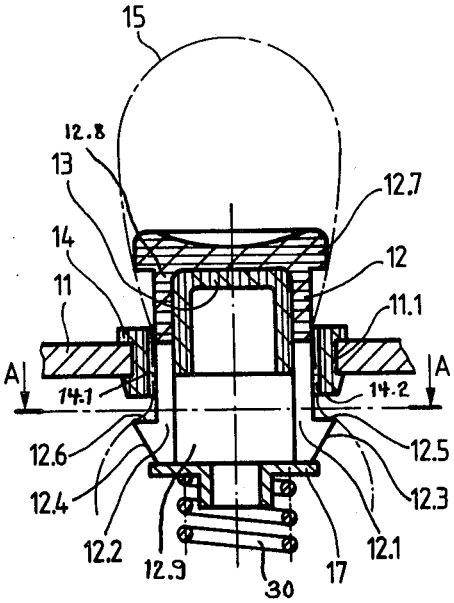
FIG. 3 is a fragmentary sectional view, analogous to the illustration of FIG. 1, of a cover plate or the like having a second construction of push button mounted therein.
Figure 4:
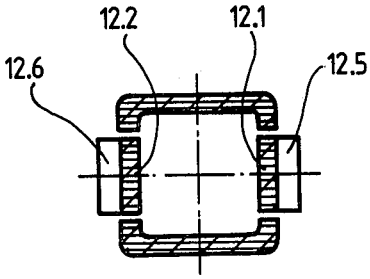
FIG. 4 is a cross-sectional view of the push button depicted in FIG. 3, taken substantially along the line A—A thereof.

The push button 12 according to the modified embodiment of FIGS. 3 and 4 possesses additional advantages over the push button construction of FIGS. 1 and 2. By virtue of its configuration or shape it can be depressed without any particular measures into the recess or opening 14.1 of the slide guide or guide means 14 which rests in the cover plate 11 and is likewise automatically retained by the action of the impact cams or detents 12.5 and 12.6 of the resilient tongues 12.1 and 12.2, respectively, at the rear-side flange or end 14.2 of the slide guide or guide means 14. Upon actuation of this push button 12 the movement is likewise limited due to impact of the upper flange member 12.7 against the slide guide or guide means 14, and when the push button 12 is released it likewise snaps back into its rest position under the action of the spring-loaded or spring-biased support member 17 of the rear side installed switch. However, both movements are dampened by the dampening action exerted by the materials from which there are formed the push button 12 and the guide means 14 during its front and rear impact moments, so that practically no impact noise is formed. The dismantling of the push button switch 12 is again accomplished with the aid of the PVC-foil or strip 15 in the already described manner.

The invention is, of course, not limited to the illustrated exemplary embodiments. The impact cams or detents could be also constituted, for instance, by a substantially cylindrical-shaped pin or plug member which is pressed outwardly by a compression or pressure spring and secured internally of the push button by means of a flange. This cylindrical pin member is slidingly guided within the body of the push button. Instead of the exemplary illustrated embodiments of push buttons having the quadratic or square cross-sectional configuration depicted in FIGS. 2 and 4, it is of course readily possible for these push buttons to have a completely different cross-sectional shape, for instance, a circular cross-sectional configuration.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A push button, especially for an electrical switch, and which is capable of being guided and retained in a cove plate and can be manually actuated against the force of a push-out spring, comprising:

a push button body;

said push button body being provided with a rigid front flange for limiting an actuation path of the push button;

a rear impact member provided for the push button body for limiting a push-out path of the push button out of the cover plate;

said rear impact member comprising at least two impact detents which are slightly resiliently yieldable;

said impact detents being arranged at opposite sides of the push button body;

said impact detents possessing impact surfaces extending substantially parallel to the cover plate;

said push button body has a hollow space;

a substantially U-shaped blade spring arranged in said hollow space of the push button body;

said substantially U-shaped blade spring having a leg member defining at least one of said impact detents;

said leg member being bent essentially at right angles out of said substantially U-shaped blade spring; and said push button body having a substantially transversely extending slot through which emerges said leg member out of said push button body.

2. The push button as defined in claim 2, wherein:

said substantially U-shaped blade spring has two of said leg members each defining one said impact detent; and said push button body has two substantially transversely extending slots through which emerge said leg members out of said push button body.

* * * * *